United States Patent [19]

Strazzeri

[11] Patent Number: 5,070,804

[45] Date of Patent: Dec. 10, 1991

[54] ROTATABLE, AUTOMATIC FIN DEVICE NOTABLY FOR A SAIL BOARD OR ANALOGOUS

[76] Inventor: Liborio Strazzeri, Rue des Vercheres - F 69380, Civrieux D'Azergues, France

[21] Appl. No.: 342,369

[22] Filed: Apr. 24, 1989

[30] Foreign Application Priority Data

Apr. 6, 1988 [FR] France ..... 88 04973
Feb. 20, 1989 [FR] France ..... 89 02375

[51] Int. Cl.[5] ..... B63B 39/06

[52] U.S. Cl. ..... 114/170; 114/128; 114/152; 114/169

[58] Field of Search ..... 114/127, 128, 130, 132, 114/144 R, 144 RE, 152, 162, 169, 170, 39.2; 441/74

[56] References Cited

U.S. PATENT DOCUMENTS

| | | | |
|---|---|---|---|
| 471,202 | 3/1892 | Victor | 114/170 |
| 491,545 | 5/1911 | Rouiss | 114/170 |
| 653,601 | 7/1900 | Williamson | 114/170 |
| 763,701 | 6/1904 | Taylor | 114/170 |
| 1,593,823 | 7/1926 | Gleason | 114/170 |

*Primary Examiner*—Joseph F. Peters, Jr.
*Assistant Examiner*—Clifford T. Bartz
*Attorney, Agent, or Firm*—Arnold S. Weintraub

[57] ABSTRACT

The invention concerns a directional fin of variable incidence at which are associated: two springs for returning the fin to central position and a symmetrical supple tooth fittings break the oscillations toward the exterior and facilitate the return movement of the fin toward the center. The apparatus facilitates the maneuvers of the board and reduces the efforts of the wind surfer.

15 Claims, 8 Drawing Sheets

ROTATABLE, AUTOMATIC FIN DEVICE NOTABLY FOR A SAIL BOARD OR ANALOGOUS

BACKGROUND OF THE INVENTION

1. Field of the Invention

The present invention is relative to an apparatus concerning a directional fin of the type that one uses on a sail board, on a drifter, on a floating board without a sail called "surfboard", or the same on the lateral floats of a trimaran hull boat.

2. Prior Art

One knows that a device of this type, for example a sail board, comprises at the back at the least a fin which is found submerged vertically in the water under the back of the floating hull. Most of the time, such a fin is fixed.

SUMMARY OF THE INVENTION

The present invention has a goal to produce a sophisticated fin, notably for the sail board or for the surf (board) to facilitate driving the machine, while reducing the necessary efforts for this and offering some of the possibilities of new use.

A sophisticated fin according to the invention, arranged under the hull of a floater, is characterized in that it is integral with a vertical axis whose upper part is oriented in rotation in a bearing carried by the hull, the upper part of this axis being equipped with an elastic adjuster for bringing the adjustable fin back to central neutral position, while being capable of opposing the rotation of the axis, with a dissymmetrical resistance. When the axis and the fin separate themselves from their neutral position, the elastic return means, causes the axis and the fin stretch to return toward a neutral position.

According to another characteristic of the invention, the upper part of the vertical axis is integral with a radial arm which is perpendicular to the vertical axis and the extremity of the arm sweeps a trajectory in an arc of a circle, centered on the vertical axis oscillating around the fin. The elastic means is positioned at given locations with this arm for returning the arm toward the neutral position which is at the middle of the trajectory.

According to another characteristic of the invention, the means of resilient return are constituted by two compression springs in an arc of a circle, situated one on each side of the oscillating arm.

According to another characteristic of the invention, each one of the two springs in an arc of a circle comprises a means of support whose position is adjustable which permits the user to modify the allowance for tare of each of the springs.

According to another characteristic of the invention, the means of adjustable support are constituted, for each spring, by a housing receptor situated in a trolley or movable grooved arc, the fixed position of the groove being adjustable the length of the trajectory in an arc of a circle.

The invention further comprises a means of adjustment for the position of each trolley. The means comprises a curvilinear rack bar, located on the side of the trolley and an adjustable pinion capable of rotation, located on a fixed socket, the means of adjustment mobilizing the pinion at the chosen adjustment position.

The invention further comprises a means for the asymmetric braking of oscillating movement of the axis of the fin are constituted by friction fittings with asymmetric, flexible teeth, these fittings being mounted at a fixed post with the teeth in contact with the oscillating arm. The arm deforms the fittings until they oscillate toward the right or toward the left.

Each fitting has an outline in an arc of a circle and, located in given positions from the central position, comprising flexible teeth inclined toward the exterior, that is to say in the opposite, divergent directions.

The invention further comprises two stops comprising magnetic means of diminished intensity, which return the extremity of the arm to place by magnetic attraction.

The magnetic means function to immobilize the arms in neutral position between the two end stops, this position corresponding to the neutral orientation of the fin, for navigation in a straight line.

A second embodiment of the invention utilizes a magnetic means of provisionally immobilizing the arm in central, neutral position. This means constitutes at least one permanent, fixed magnet located at the end of the path defined by the radial arm rotating through an arc. The arm has a magnetic extremity. The magnetic extremity of the arm crosses the path of the magnet when the arm draws its trajectory between the two extreme stops. The fixed magnet functions as a magnetic stop.

According to another characteristic of the invention, each of these two magnetic stops of the extremity possess means of adjustment permitting adjustment from the exterior of the position at which one immobilizes the arm. This permitting regulating the maximum amplitude of the oscillations of the arms in both directions.

The invention further comprises a means of adjusting each magnetic stop comprising a longitudinal screw which drives a nut in rotation with an endless screw or a gear whose head is accessible from the exterior.

The attached drawing, given by way of non-limiting example, permits to better understand the invention and the advantages it is susceptible of procuring.

Figure 3:
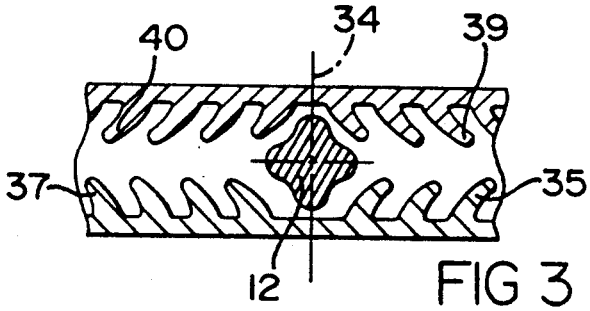
FIG. 3 is a partial section following III—III (FIG. 2) illustrating the means of asymmetrical breaks.
Figure 5:
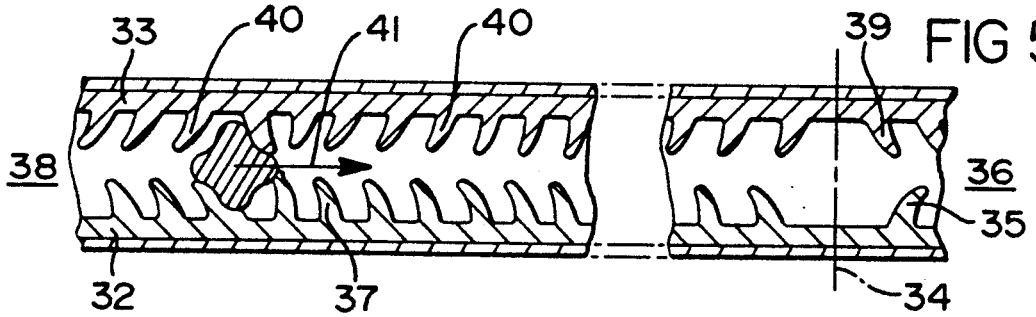

FIG. 5 corresponds to FIG. 3 when the arm returns to its central, neutral position.

Figure 6:
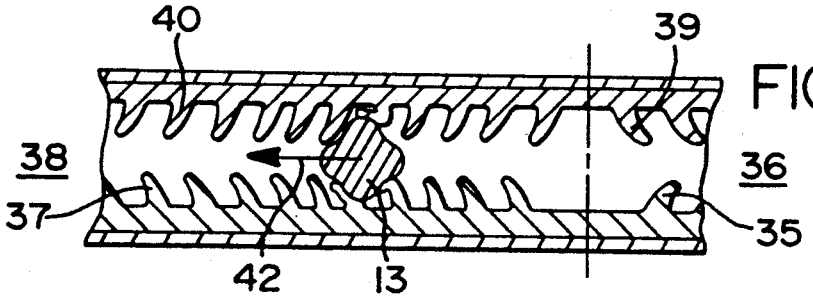

FIG. 6 is an analogous view when the arm deviates contrary to its central, neutral position.

Figure 7:
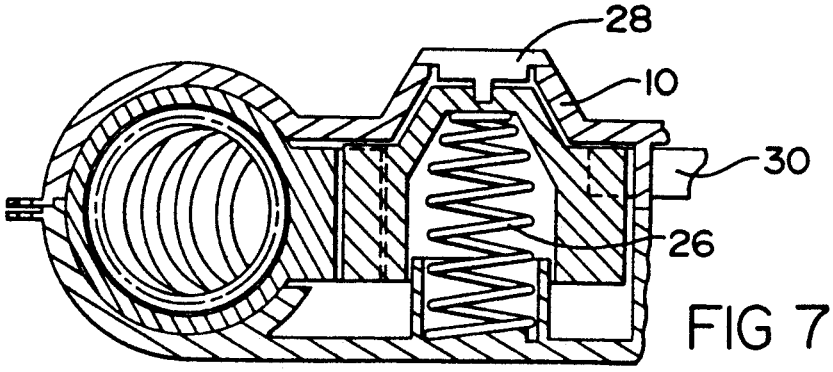

FIG. 7 is a section following VII—VII (FIG. 4) showing an allowance for tare trolley in locked position.

Figure 8:
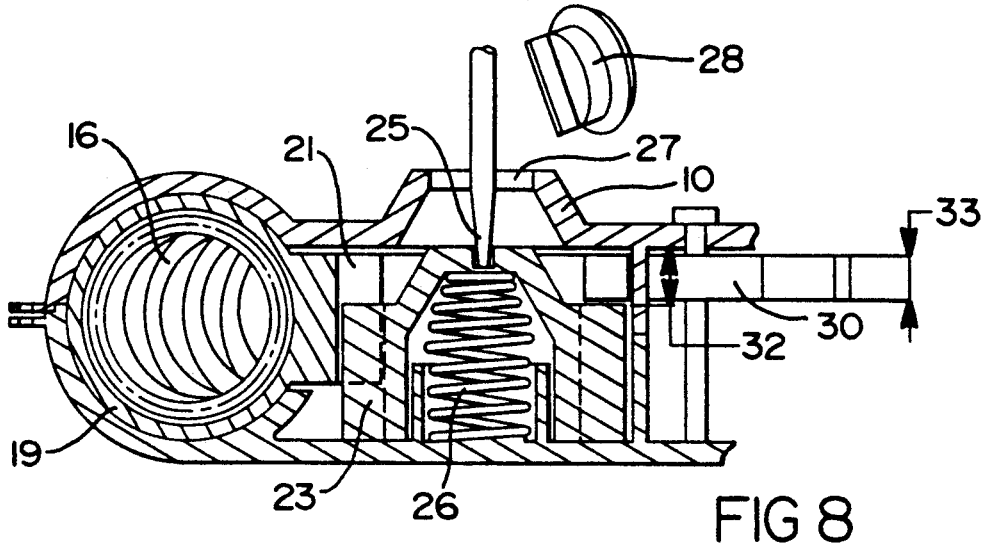

FIG. 8 is an analogous section when the pinion of the trolley is thrust, in adjusting position.

Figure 4:
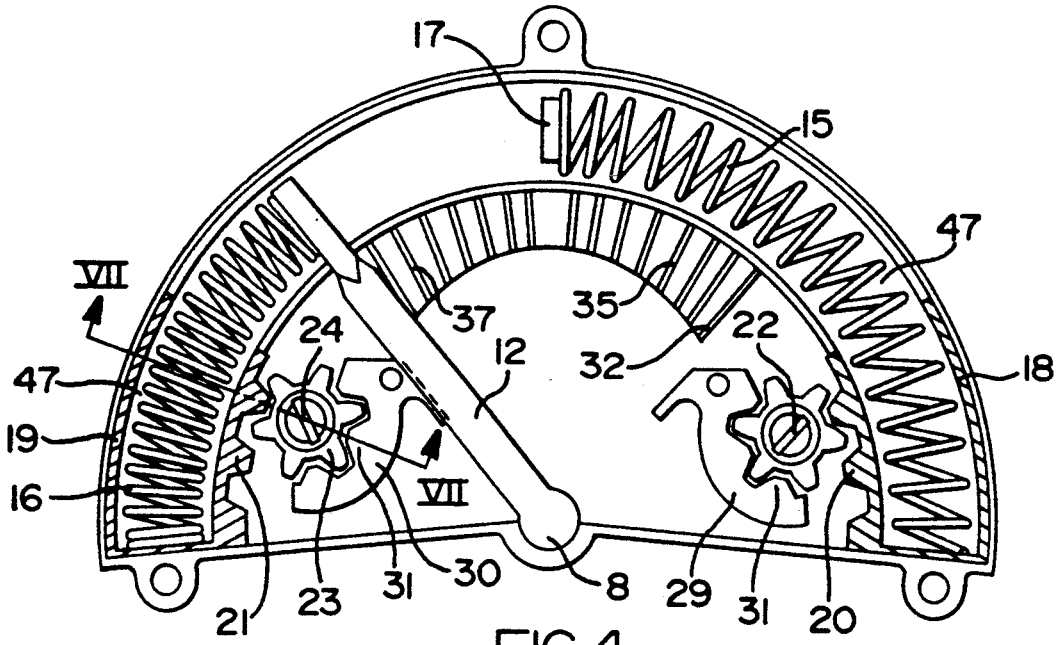
FIG. 4 is a plane view of the apparatus of FIG. 2, when the arm operates the fin is deviated toward the port side.
Figure 9:
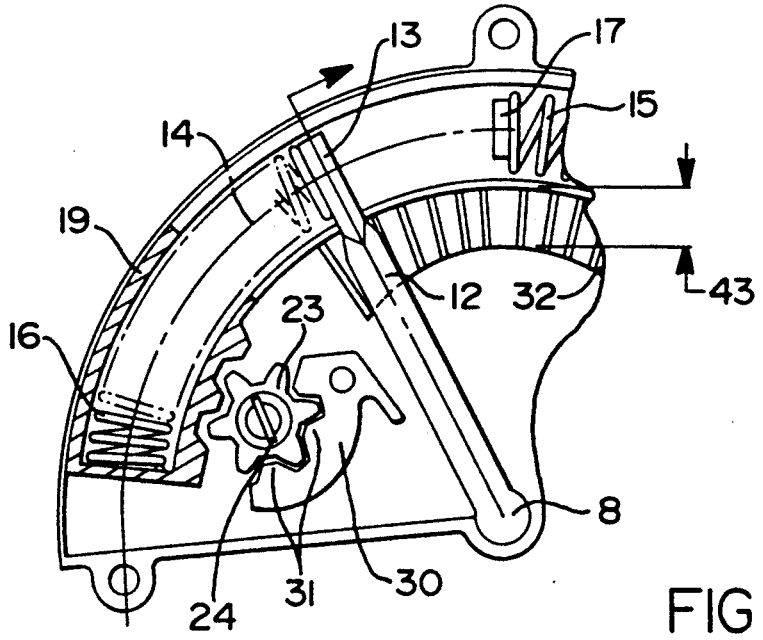

FIG. 9 is an analogous view to that of FIG. 4, but for a different adjustment of the port side, allowance for tare trolley.

Figure 10:
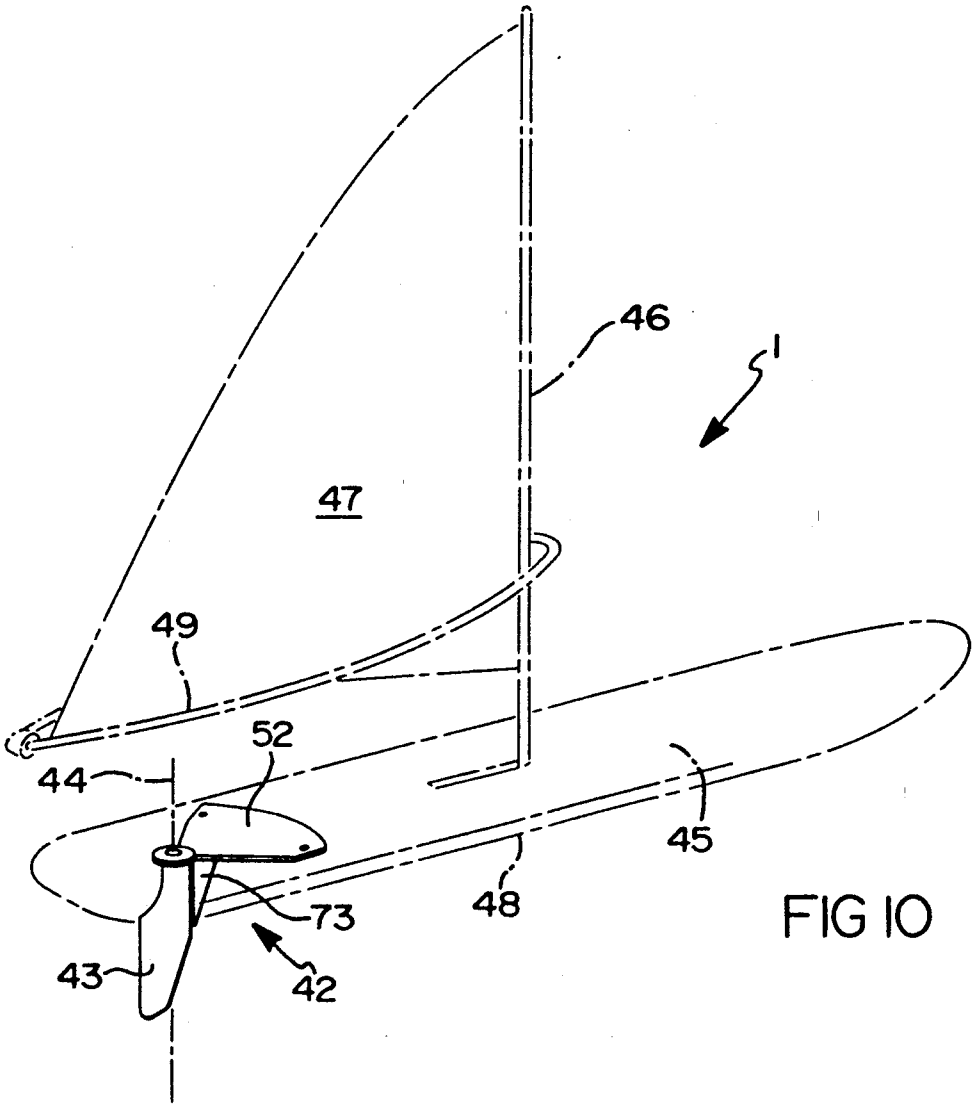

FIG. 10 shows the entirety of the sail boat whose orientable fin is equipped with an apparatus according to the invention.

Figure 11:
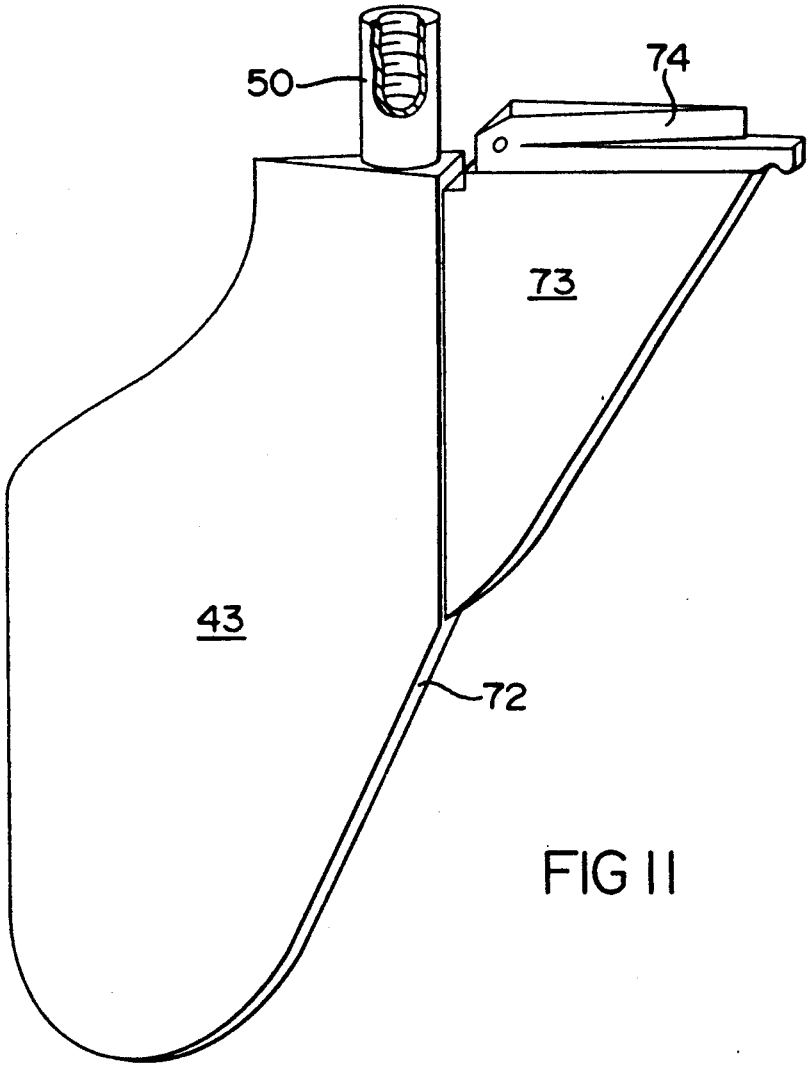

FIG. 11 shows the breakdown of the directional fin and of its vertical driving shaft.

Figure 12:
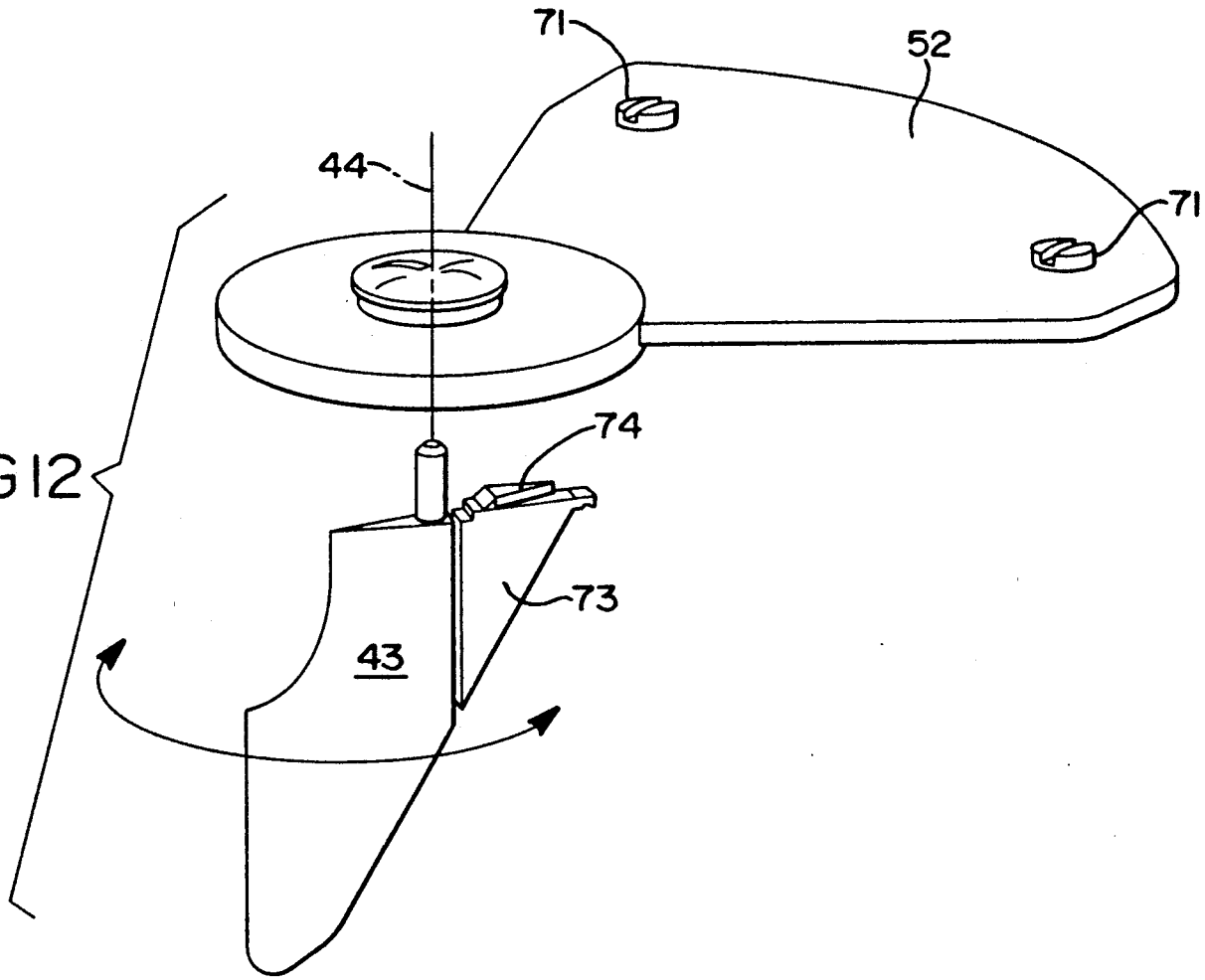
Figure 13:
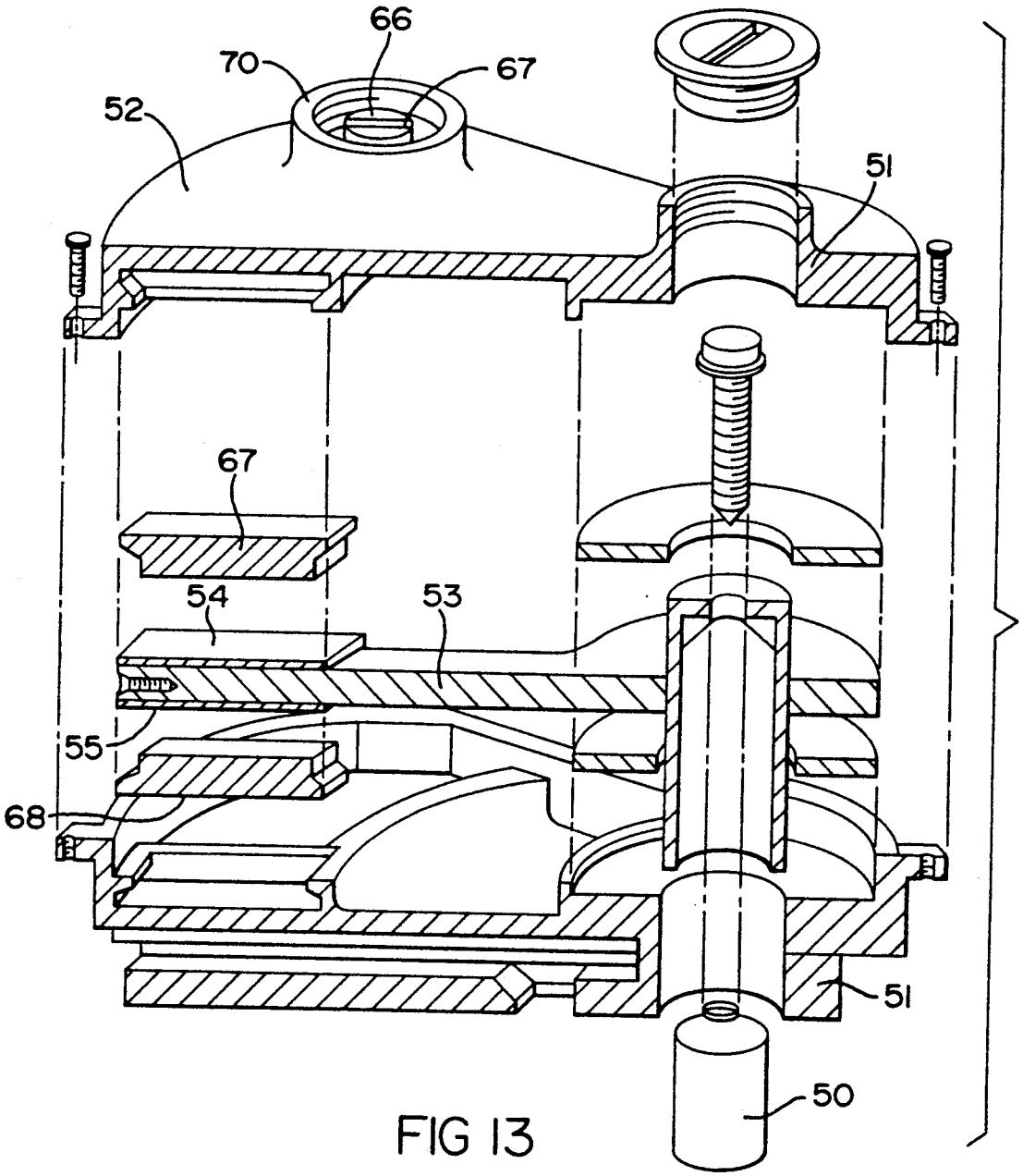
Figure 14:
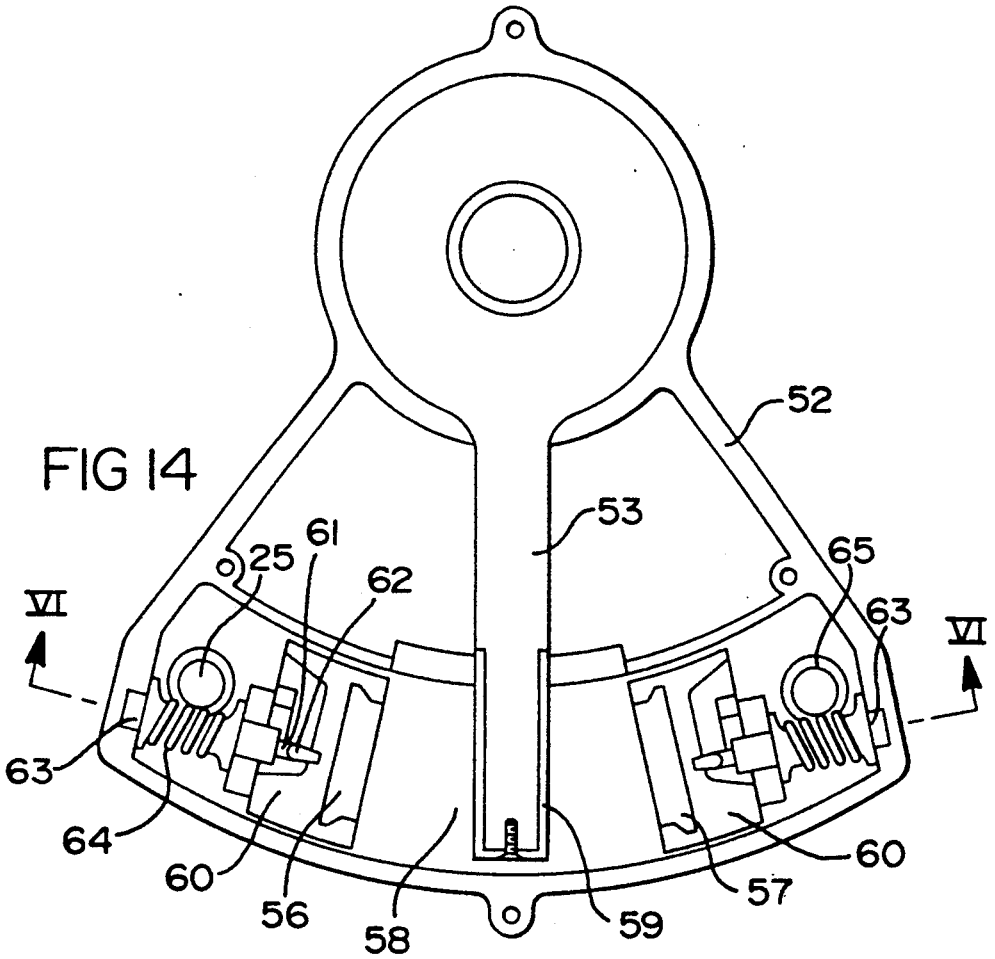
Figure 15:
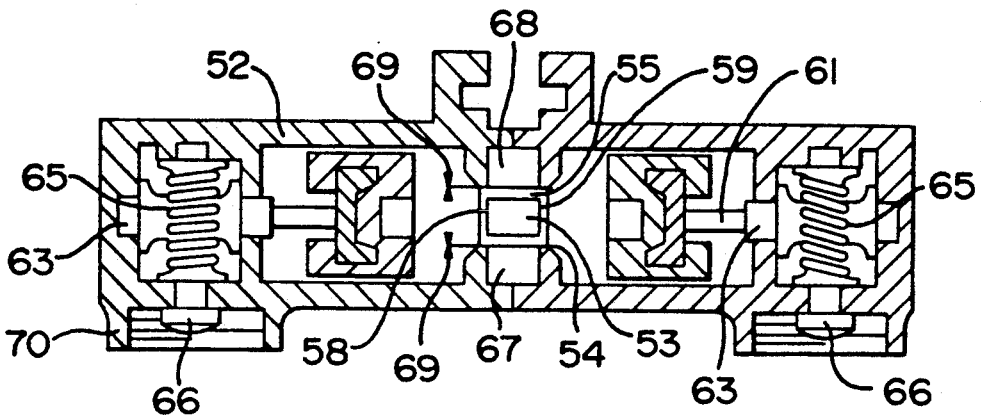

FIG. 12 is a sectional view showing the entirety of the apparatus;

FIG. 13 is a sectional view showing the oscillating arm and the interior of the fixed casing;

FIG. 14 is a plane view of the apparatus of FIG. 4;

FIG. 15 is a developed section following VI—VI (FIG. 5).

Represented in the drawings is a sail board equipped with an apparatus 1 according to the invention. This apparatus 1 controls a directional fin 2 with a variable impact.

The sail board comprises a float or hull 3, a mast 4 and a sail 5. The hull 3 is equipped in a known manner of a drift 6. The ensemble is completed by an arch or wishbone 7 equally known.

The fin 2 is integral with a vertical shaft 8 whose upper part liberally turns in the bearings 9 of a fixed casing 10, integral with the hull 3. Watertightness is assured by toric joints 11 provided on the turning shaft 8 at the level of the bearings 9.

Figure 1:
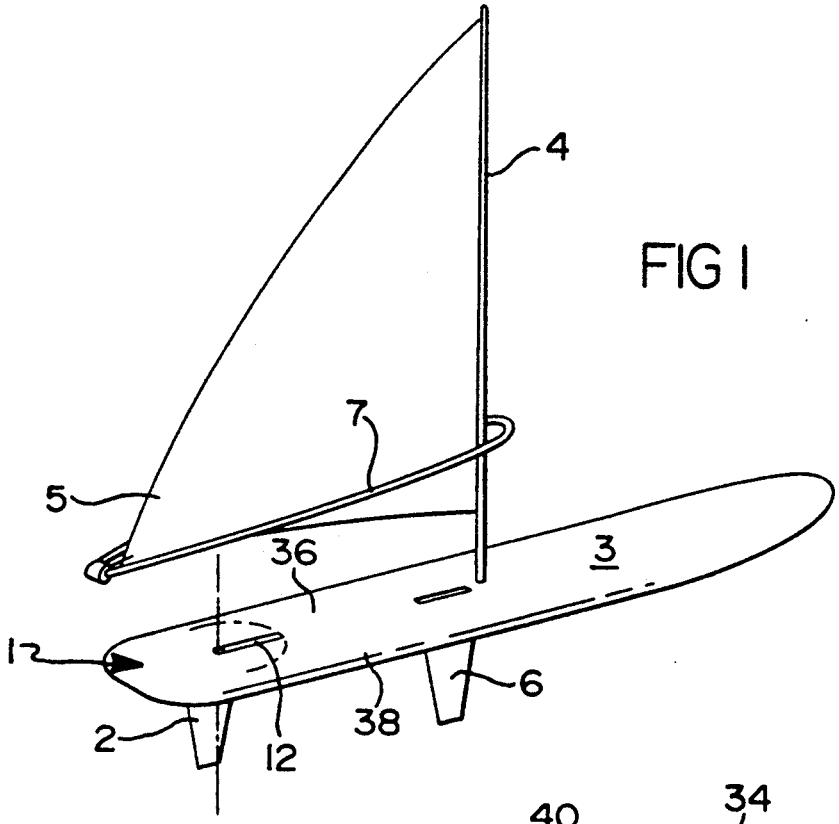
FIG. 1 is a comprehensive view of a sail boat equipped with an apparatus according to the invention.

The upper part of the shaft 8 is integral with a radial arm 12 which is perpendicular to the shaft and the extremity of the arm 13 sweeps a trajectory in an arc of a circle 14, between two opposed compression springs 15 and 16. At the middle of this trajectory 14 stops 17 are provided for the springs 15 and 16. The stops 17 correspond to the neutral position of the arm 12 and the orientatable fin 2. In the position shown in FIGS. 1 and 2, the fin 2 is orientated in the access of the hull 3 which advances in a straight line.

Opposite the central stops 17, each spring 15, 16 is supported in the housing 8, 7 of two adjustable fixed trollies, referenced respectively 18, 19. Each of these trollies 18, 19 comprises a profile in the arc of a circle and, on the exterior face the most near to the central shaft 8, a toothed rack 20, 21. Each of these teeth engages on a pinion 22, 23 whose upper face possesses a diametrical groove 24 susceptible of receiving the extremity of an adjusting screwdriver 25 (FIG. 8).

Each pinion 22, 23 is hollow and it caps a compression spring 26. The spring elastically returns the pinion toward the top, against the casing 10. An opening 27 is located in the casing for introduction of a screwdriver 25 to facilitate adjustment. Each opening 27 is re-closed by a removable cover 28 (FIG. 7).

A stop anchor 29, 30, having a catch 31, is provided to immobilize each pinion 22, 23. The teeth of the pinion are engaged by the catches 31. Each anchor 29, 30 immobilizes the corresponding pinion 22, 23 from rotating when the pinion is in resting position under the push of its spring 26 (FIG. 7). If a user presses with the screwdriver 25 to drive the pinion 23 in toward the bottom (FIG. 8), the pinion goes down to a height 32 (FIG. 8) which is superior to the depth 33 of the anchor 30. In this low position, the teeth of the pinion 23 escape from the stop catches 31 of the anchor 30, but remain engaged on the toothed rack 21. By turning the screwdriver 25, the operator can turn the pinion 23 which displaces the trolley 19 the length of the trajectory 12 to allow for adjustment of the tension of the spring 16. Once the desired position is attained, it suffices that the utilizer remove the screwdriver 25: the pinion 23 goes up again under the push of its spring 26 and engages once again on the catches 31 of the anchor 30. The trolley 19 is then automatically locked in its new position (FIG. 9).

The arm 12 preferably has a transversal section in the form of an ace of diamonds (FIGS. 3, 5 and 6). The arm rubs against the supple teeth of two fixed fittings an upper fitting 33 and a lower fitting 32, located above and below the arm respectively in the arc of a circle 32 and 33 to displace itself. On the same lower fitting 32, in given positions from the central, neutral position 34 defined by the thrust 17, the teeth are inclined in opposed, divergent positions. The supple teeth 35 of the port side 36 are oriented toward the top and toward the port side, then the supple teeth 37 of the starboard side 38 are oriented toward the top and toward the starboard.

In the same way, on the upper fitting 33, the port side teeth 39 are inclined toward the bottom and toward the port side, even when the starboard teeth 40 are inclined toward the back and toward the starboard side. In fact these teeth 35, 37 and 39, 40 are staggered in zigzag.

When the arm 12 oscillates from the star board 38 in the direction of the central, neutral position 34 (FIG. 5, arrow 41), it pulls up in the opposite direction at the time the superior teeth 40 and the inferior teeth progressively clear them: the return movement of the arm toward the central position 34 is thus energetically stopped. Even without this brake system movement can completely be opposed, because the push of the return spring 16 or 15 remains superior). By the act of staggering in zigzag, the teeth provide braking action. When the arm 13 oscillates in the opposite direction (arrow 14, FIG. 6) it simply augments the natural curvature of the supple teeth 37, 40 thereby offering a feeble resistance, in a continuing fashion. The operation is the following.

In the utilization, the wind surfer pushes with his foot against the hull 3. Under the effect of this push, in accordance with the wind and the direction of the advancement of the board, the fin 2 has a tendency to take a direction naturally. This demands an effort on the part of the wind surfer.

When the surfer releases the stress, the fin 2 has a tendency to come back toward its neutral position 34 but this return movement is retarded by the fittings 32, 33.

The fittings easily allow the movement of the arms 12 to spread out or deviate from the trajectory of the board (case of arrow 82, FIG. 6). The fittings provide braking action in the inverse sense (case of return, arrow 81, FIG. 5).

Moreover, the stronger the wind, the more it causes variance of the direction of the fin. The tension of the springs 15, 16 should then be adjusted at the most important values: when the springs are in position with the trollies 18, 19; or in the position of decreased tension; or in a position of increased stronger tension (FIG. 9).

To compensate for the fact that the push of each spring 15, 16 diminishes when the arm 12 draws nearer to the central position 34, the fittings 32, 33 are equipped with a width 83 more narrow in the central part close to the position 34.

Figure 2:
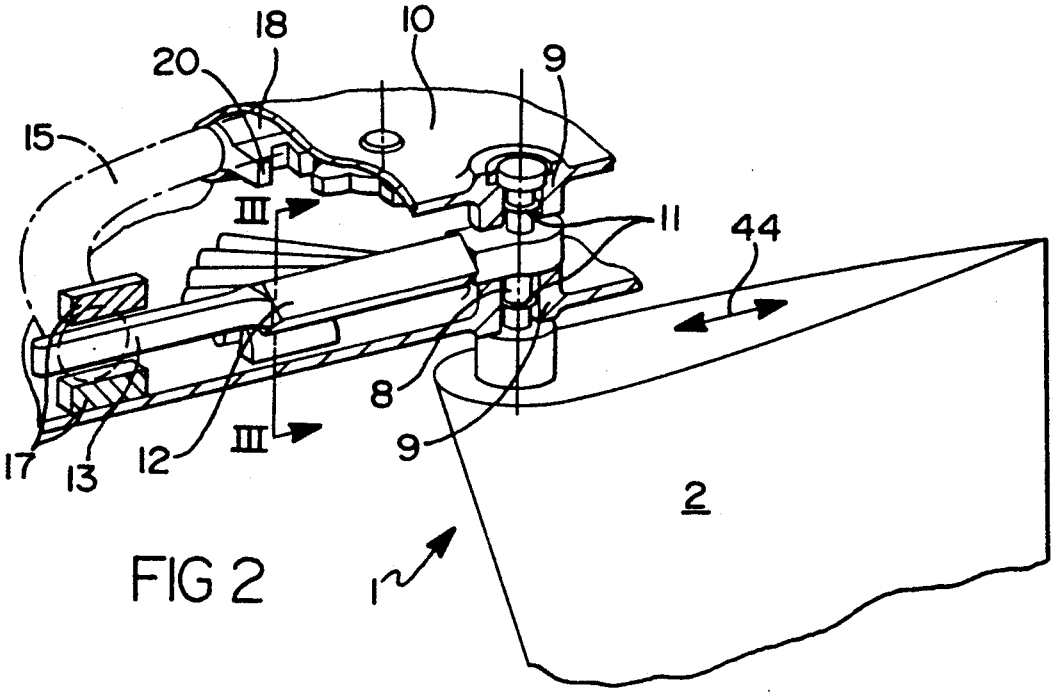
FIG. 2 is a view in perspective with partial section of the directional fin apparatus.

Other equivalent means to regulate the intensity of the elastic reaction of returning the pivoting fin, would involve modifying the position of the fin 2 with respect to the pivot shaft 8 indicated in FIG. 2 at 84.

The apparatus of the present invention is particularly useful when the operator navigates on a wind.

One has represented in FIGS. 10–15, a sailboard 1 equipped with an alternative embodiment of the present invention. The apparatus 42 concerns a directional fin 43 whose orientation can be variable by rotation around a theoretical, vertical axis 44.

The sail board 1 comprises a float or hull 45, a mast 46 and a sail 47. The hull 45 is equipped in the known manner of a drift 48. The ensemble is completed by an arch or wishbone 49 equally known.

The fin 43 is integral with a vertical shaft 15 having an upper part and a lower part whose upper part turns liberally in the bearings 51 of a fixed casing 52, integral with the hull 45. Watertightness is assured by toric joints not represented.

The upper part of the shaft 50 is integral with a radial arm 53. The arm is perpendicular to the shaft and the extremity of the arm is equipped with two ferromagnetic parts, namely an upper part 54 and a lower part 55.

The fin 43, comprises a shaft 50 which oscillates around a vertical axis 44. The extremity of the arm 53 sweeps a trajectory in an arc of a circle (FIG. 14) between two adjustable, fixed stops 56 and 57. Each of these two stops comprises a permanent magnet, having ferromagnetic cheeks 58, 59 to allow the extremity of the arm 53 to adhere to each end of the path of the arm 53.

Each magnetic stop 56, 57 is integral with a sliding block 60. The block receives the push of a longitudinal screw 61 which is articulated in an aperture 62. On each screw 61 is aimed a rotative nut 63 whose exterior part comprises a gear or an endless tooth screw 64. The gear engages an endless screw or on a (toothed) gearing 65 whose head 66 is accessible from the exterior of the hull 45. Each head 66 comprises a diametrical groove 67 as in the case illustrated in FIG. 13: one can then set each of the two heads 66 in motion with a simple screwdriver. Rotation in one direction or in the opposite direction permits adjustment of the longitudinal position of each of the two magnetic, fixed adjustable stops 56 and 57.

Finally, two permanent, fixed, magnets an upper magnet 67 and a lower magnet 68 are incorporated in the casing 52. These two magnets 67 and 68 face one another, and are separated by the upper and lower ferromagnetic parts 54, 55. Between the permanent magnets 67, 68 and the ferromagnetic parts 54, 55 is a clearance 69. The arm 53 can pass between the reduced clearance 69. When the magnetic attraction is sufficient to immobilize the fittings 54 and 55 of the arm 53 between the two magnets 67 and 68, the arm 53 and the fin 43 find themselves immobilized in central, neutral position, indicated at 4 causing the sail board 1 to advance in a straight line.

To complete the preferred embodiment, it is advantageous to place each adjustment head 66 at the bottom of a casing 52 surrounding a well 70. This well can eventually be re-closed by a removable plug 71.

In the realization illustrated in FIGS. 10, 11 and 12, one has anticipated in front of the leading edge 72 of the adjustable fin 43, a small fixed fin 75 whose orientation can be adjusted from a head 74. The presence of this small fixed fin 75 is optional.

The invention functions as follows:

During utilization, the wind surfer pushes with his foot against the hull 45. Under the effect of this push, according to the wind and to the direction of advancement of the board 1, the fin 43 has a tendency to naturally take an orientation. In fact, it resists this tendency, under the effect of the magnetic, provisional immobilization to which it is subjected. In effect, the ferromagnetic extremities 58, 59, 54, 55 are in the following positions:

an immobilized position;

a position against the magnetic thrust 56;

a position against the magnetic thrust 57;

a position between the two magnets 67 and 68 of the neutral position.

In each of these three cases, the magnetic force of immobilization remains effectual until a threshold of given stress. As soon as the wrenching force exceeds this threshold, the arm 53 moves from the aforementioned position and takes a new orientation: except for the exceptional case, this new orientation corresponds to the immobilization of one or the other of the magnets.

One understands that the apparatus according to the invention permits the fin 43 to occupy a fixed position, amongst three angular positions defined by the diverse magnets. Additionally, the passage from one to the other of these three positions is automatically effectuated by magnetic wrenching, as soon as the effort resulting from that force surpasses the allowance for the tare threshold of the magnets.

I claim:

1. An apparatus for the operation of a directional fin of a sail board comprising:

(a) a vertical shaft attached to the hull of the sail board comprising an upper part and a lower part wherein the lower part is integral with the top of the directional fin, the shaft being supported vertically by a bearing assembly mounted in the hull;

(b) a radial arm attached perpendicularly to the upper part of the shaft, the arm rotating through an arc centered on a vertical rotational axis of the shaft;

(c) an adjustable elastic means which controls the radial arm in its rotational motion, comprising first and second compression springs and an adjustable means of support for each spring, wherein the spring and support means are located on either side of the radial arm and the tension of each spring is adjustable independently; and (d) separate friction members to dampen oscillation in the radial arm and vertical shaft of the directional fin during operation.

2. The apparatus of claim 1, wherein the adjustable means of support for each spring comprise:

(a) a trolley, whose fixed position is adjustable along the length of the arc transcribed by the radial arm; and (b) a receiver housing situated in the trolley.

3. The apparatus of claim 2, further comprising a means of adjustment for the position of each trolley which comprises:

(a) a curvilinear toothed rack; and (b) a pinion located on a fixed socket, which is adjusted by rotation of the pinion whose teeth engage those of the toothed rack;

(c) a retractable means which permits the immobilization of the pinion to a chosen adjustment position.

4. The apparatus of claim 3, wherein the means for immobilizing the pinion comprises:

(a) a stop anchor having a plurality of stop catches to engage the teeth of the pinion, thereby immobilizing the pinion; and (b) a spring release means for disengaging the pinion from the stop anchor.

5. The apparatus of claim 4, comprising a means to override the spring release means for adjustment of the pinion which further comprises an engagable recess, located at the top of the pinion, wherein a tool can be engaged to lower the pinion and disengage it from its anchor to turn the pinion to adjust the tension of the corresponding spring.

6. The apparatus of claim 1 wherein the means for dampening oscillation in the radial arm and vertical shaft of the fin comprise at least one frictional member having asymmetrical, supple teeth which are mounted at a fixed portion, wherein the teeth contact the radial arm, and are deformable by the arm in response to movement thereof.

7. The apparatus of claim 6, wherein the frictional member follows the arc of a circle centered on the vertical rotational axis of the fin and on either side of the central position of the radial arm, and the supple teeth incline on the member toward the outside, or away from the central position.

8. A directional fin apparatus for operation of a directional fin on a sail board, comprising;

(a) a vertical shaft having an upper part and a lower part, wherein the lower part of the vertical shaft is integral with the top of the fin, the shaft being supported vertically by a bearing assembly mounted in the hull of the sail board;

(b) a radial arm attached perpendicularly to and integral with the upper part of the shaft, said arm rotating through an arc centered on the vertical rotational axis of the shaft and the radial arm being controlled in its rotational motion by a magnetic means to apply resistance to and to return the arm to a central, neutral position when moved away from the neutral position.

9. The apparatus of claim 8, wherein the magnetic means comprises two sets of stops, located at either end of a path defined by the radial arm rotating through an arc centered on the vertical rotational axis of the vertical shaft.

10. The apparatus of claim 9, further comprising a means of adjustment for adjusting the position of the two magnetic stops, to permit adjustment of the maximum amplitude of the arm rotation in either direction and to maintain the arm in neutral position.

11. The apparatus of claim 10, wherein the means for adjustment of each magnetic stop comprises a longitudinal screw and nut, the nut engaging in rotation with a gear to adjust the longitudinal position of the two magnetic stops.

12. The apparatus of claim 11, wherein the longitudinal screw comprises a head which is accessible to the exterior to facilitate external adjustment.

13. The apparatus of claim 8, which further comprises two permanent fixed magnets, located above and below the radial arm and two extreme stops, the radial arm passing through the magnets to define a trajectory between the two extreme stops.

14. The apparatus of claim 13, wherein the extremity of the radial arm comprises two ferromagnetic fittings situated on the radial arm in a manner to pass between the two permanent fixed magnets located above and below the radial arm.

15. The apparatus of claim 8, further comprising a fixed adjustable fin set out on the leading edge of the directional fin.

* * * * *